US010619287B2

(12) United States Patent
Lu et al.

(10) Patent No.: US 10,619,287 B2
(45) Date of Patent: Apr. 14, 2020

(54) HEAT PUMP DRYING OR WASHING-DRYING MACHINE

(71) Applicant: WUXI LITTLE SWAN ELECTRIC CO., LTD., Wuxi (CN)

(72) Inventors: Song Lu, Wuxi (CN); Yulai Miao, Wuxi (CN); Wei Qian, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 483 days.

(21) Appl. No.: 15/382,818

(22) Filed: Dec. 19, 2016

(65) Prior Publication Data

US 2017/0342644 A1 Nov. 30, 2017

(30) Foreign Application Priority Data

May 31, 2016 (CN) ..... 2016 1 0375588
May 31, 2016 (CN) ..... 2016 2 0513883 U

(51) Int. Cl.
*D06F 58/20* (2006.01)
*D06F 58/22* (2006.01)
*D06F 25/00* (2006.01)

(52) U.S. Cl.
CPC ..... *D06F 58/206* (2013.01); *D06F 58/22* (2013.01); *D06F 25/00* (2013.01)

(58) Field of Classification Search
CPC ..... D06F 58/206; D06F 58/22; D06F 25/00
See application file for complete search history.

(56) References Cited

U.S. PATENT DOCUMENTS 6,709,499 B2 * 3/2004 Moschutz ..... D06F 58/22 34/526
2014/0208604 A1 * 7/2014 Kim ..... D06F 58/26 34/82

FOREIGN PATENT DOCUMENTS

JP 2005256635 A * 9/2005

* cited by examiner

*Primary Examiner* — Jessica Yuen
(74) *Attorney, Agent, or Firm* — Morgan, Lewis & Bockius LLP

(57) ABSTRACT

A heat pump drying or washing-drying machine is provided. The heat pump drying or washing-drying machine includes a heat pump module, and the heat pump module includes a soft-flock filtering mesh assembly having a first support frame and a second support frame which are used for mounting the soft-flock filtering mesh, and the second support frame is disposed to the first support frame, so that the soft-flock filtering mesh assembly is capable of being mounted and dismounted as a whole.

6 Claims, 2 Drawing Sheets

HEAT PUMP DRYING OR WASHING-DRYING MACHINE

RELATED APPLICATIONS

This application claims priority and benefits of Chinese Patent Application No. 201610375588.8, filed with State Intellectual Property Office on May 31, 2016, and Chinese Patent Application No. 201620513883.0, filed with State Intellectual Property Office on May 31, 2016, the entire content of which is incorporated herein by reference.

FIELD

The present disclosure relates to a technical field of washing equipment, and more particularly to a heat pump drying or washing-drying machine.

BACKGROUND

In a general heat pump washing-drying machine, a soft-flock filtering mesh assembly has a relatively complex structure. Some soft-flock filtering mesh assemblies are provided with two layers of support frames, the two layers of support frames are mounted and dismounted by drawing respectively, so that operations thereof are relatively cumbersome.

SUMMARY

Present disclosure seeks to solve at least one of the problems existing in the related art to at least some extent. For this purpose, the present disclosure provides a heat pump drying or washing-drying machine. It is very easy to mount and dismount of a soft-flock filtering mesh assembly in the heat pump drying or washing-drying machine.

According to embodiments of the present disclosure, the heat pump drying or washing-drying machine includes a heat pump module, and the heat pump module includes a soft-flock filtering mesh assembly having a first support frame and a second support frame which are used for mounting a soft-flock filtering mesh, and the second support frame is disposed to the first support frame, so that the soft-flock filtering mesh assembly is capable of being mounted and dismounted as a whole.

In the heat pump drying or washing-drying machine according to embodiments of the present disclosure, by disposing the second support frame to the first support frame, the soft-flock filtering mesh assembly can be mounted and dismounted as a whole, thereby greatly facilitating the mounting, the dismounting and the cleaning of the soft-flock filtering mesh assembly, and reducing the operation complexity.

In some embodiments, the first support frame includes a first frame body having an annular shape, and the second support frame is embedded in the first frame body. Thus, it is very easy to connect the first support frame with the second support frame.

Specifically, the first support frame further includes a first support rod disposed in the first frame body. Thus, the first support rod can support the soft-flock filtering mesh, so as to prevent the soft-flock filtering mesh from being broken or lifted due to insufficient supporting, thereby improving the using utility of the soft-flock filtering mesh.

Further, in a thickness direction of the first support frame, an area surrounded by the first frame body includes a soft flock collecting area, a support area, and a mounting area in turn, in which the first support rod is disposed in the support area, the second support frame is disposed in the mounting area, and the soft flock collecting area is located at a windward side of the soft-flock filtering mesh assembly. Thus, it is convenient to mount the second support frame to the first support frame and to allow the first support frame to have a box-shaped structure at the windward side, in which the box-shaped structure of the first support frame has a strong soft flock collecting function.

In some embodiments, the second support frame has a second frame body having an annular shape and a second support rod disposed in the second frame body. Thus, the second support frame has a simple structure and is easy to be produced, and moreover, the structure strength of the second support frame can be improved by disposing the second support rod.

Specifically, the second support rod is parallel to and staggered with the first support rod. Thus, a supporting effect on the soft-flock filtering mesh can be further improved.

Further, the first support frame is provided with a handle. Thus, it is convenient to draw the soft-flock filtering mesh assembly as a whole.

Optionally, the handle is configured to have a plate shape, and is provided with a draw hole. Thus, a user can stretch his/her finger into the draw hole to draw the soft-flock filtering mesh assembly out, so that it is much easier to dismount the soft-flock filtering mesh assembly.

In some embodiments, the heat pump module includes a heat pump mounting box, and the heat pump mounting box includes a base provided with an air suction port and an mounting cavity; and an air channel guiding plate mounted on the base and defining an air guiding channel with the base, the air guiding channel having an inlet communicated with the air suction port and an outlet communicated with the mounting cavity, in which the soft-flock filtering mesh assembly is drawably mounted to at least one of the base and the air channel guiding plate.

Specifically, the soft-flock filtering mesh assembly is disposed at the outlet.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

Figure 1:
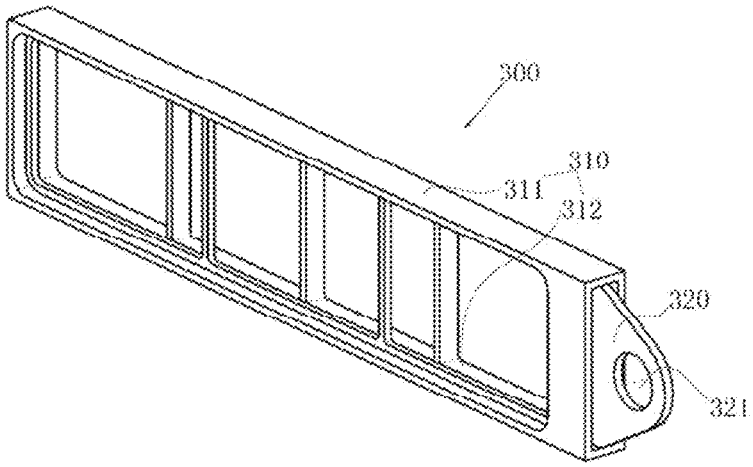
FIG. 1 is a schematic view of a soft-flock filtering mesh assembly according to embodiments of the present disclosure.

REFERENCE NUMERALS heat pump mounting box 1, base 100, mounting cavity 110, evaporator mounting area 111, condenser mounting area 112, compressor mounting area 117, air channel guiding plate 200, air guiding channel 210, inlet 211, outlet 212, soft-flock filtering mesh assembly 300, support frame 310, first support frame 311, first frame body 3111, first support rod 3112, second support frame 312, second frame body 3121, second support rod 3122, handle 320, draw hole 321, soft flock collecting area Q1, support area Q2, mounting area Q3, condenser 2, evaporator 3, compressor 4.

DETAILED DESCRIPTION

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

A heat pump drying or washing-drying machine according to embodiments of the present disclosure will be described with reference to FIGS. 1-4 in the following. The heat pump drying or washing-drying machine includes a heat pump module.

In the heat pump drying or washing-drying machine according to embodiments of the present disclosure, the heat pump module of the heat pump drying or washing-drying machine includes a soft-flock filtering mesh assembly 300 for intercepting soft flocks in a circulating airflow in the heat pump drying or washing-drying machine.

Figure 2:
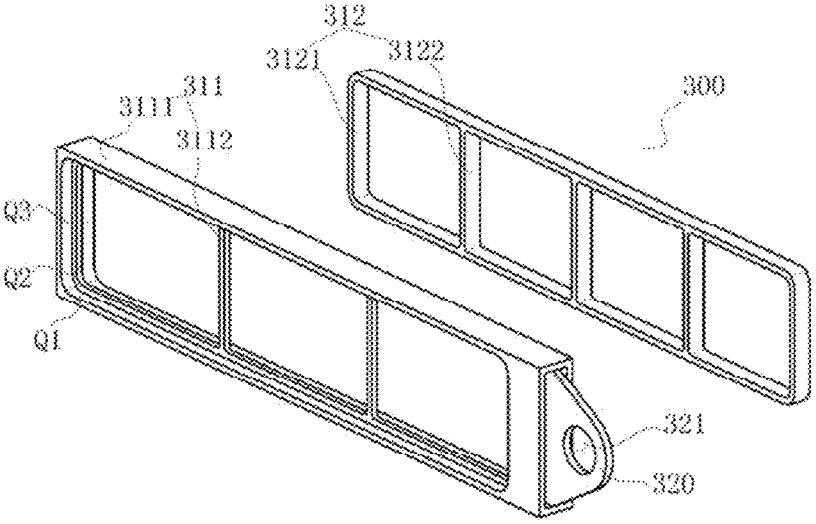
FIG. 2 is an exploded view of a soft-flock filtering mesh assembly according to embodiments of the present disclosure.

As shown in FIG. 1, the soft-flock filtering mesh assembly 300 includes a support frame 310, and a soft-flock filtering mesh is mounted to the support frame 310. Specifically, as shown in FIGS. 1 and 2, the support frame 310 includes a first support frame 311 and a second support frame 312, and the second support frame 312 is disposed to the first support frame 311. In this way, the first support frame 311 and the second support frame 312 can be assembled into one body, and thus the soft-flock filtering mesh assembly 300 can be mounted and dismounted as a whole, such that the soft-flock filtering mesh assembly 300 can be drawn out from the heat pump module to be cleaned as a whole.

In the heat pump drying or washing-drying machine according to embodiments of the present disclosure, by disposing the second support frame 312 to the first support frame 311, the soft-flock filtering mesh assembly 300 can be mounted and dismounted as a whole, thus greatly facilitating the assembling and disassembling as well as the cleaning of the soft-flock filtering mesh assembly 300, and further reducing the operation complexity.

Specifically, the support frame 310 is provided with a handle 320, thereby facilitating the overall drawing of the soft-flock filtering mesh assembly 300. Advantageously, the handle 320 is disposed to the first support frame 311.

Optionally, as shown in FIGS. 1 and 2, the handle 320 is configured to have a plate shape, and is provided with a draw hole 321. A user can stretch his/her finger into the draw hole 321 to draw the soft-flock filtering mesh assembly 300 out, so that the dismounting operation of the soft-flock filtering mesh assembly 300 is allowed to be much easier.

In some embodiments, the first support frame 311 includes a first frame body 3111 having an annular shape, and the second support frame 312 is embedded in the first frame body 3111. In this way, an outer edge of the second support frame 312 is clamped in the first frame body 3111, and the second support frame 312 can be directly drawn out from the first frame body 3111. When to be assembled, the second support frame 312 can be pressed into the first frame body 3111 directly as well, so that it is very easy to connect the first support frame 311 with the second support frame 312.

Certainly, in embodiments of the present disclosure, it should not be excluded that the second support frame 312 is fixed to the first frame body 3111 by a connector such as a snap or a screw. However, it is obvious that embedding the second support frame 312 into the first frame body 3111 directly allows the assembling process thereof to be quick and easy.

In addition, the soft-flock filtering mesh on the support frame 310 is used for filtering out the soft flocks. If the second support frame 312 is embedded into the first frame body 3111, it is not easy for a gap to be formed between the first support frame 311 and the second support frame 312, thereby improving the efficiency of filtering out the soft flocks.

Optionally, one second support frame 312 may be embedded in the first support frame 311, and a plurality of second support frames 312 may also be embedded in the first support frame 311, which is not limited herein.

Specifically, as shown in FIG. 2, the first support frame 311 further includes a first support rod 3112 disposed in the first frame body 3111, and thus the first support rod 3112 can support the soft-flock filtering mesh, so as to prevent the soft-flock filtering mesh from being broken or lifted due to insufficient supporting, thereby improving the using utility of the soft-flock filtering mesh.

Further, as shown in FIG. 2, in a thickness direction of the first support frame 311, an area surrounded by the first frame body 3111 includes a soft flock collecting area Q1, a support area Q2, and a mounting area Q3 in turn. The first support rod 3112 is disposed in the support area Q2, the second support frame 312 is disposed in the mounting area Q3, and the soft flock collecting area Q1 is located at a windward side of the soft-flock filtering mesh assembly 300.

That is to say, in the thickness direction of the first support frame 311, two side surfaces of the first support rod 3112 both are not flush with corresponding surfaces of the first frame body 3111, and the two side surfaces of the first support rod 3112 are located at inner sides of the corresponding surfaces of the first frame body 3111 respectively.

At a side facing the second support frame 312, the first support rod 3112 is located at an inner side of the first frame body 3111, so as to form the mounting area Q3, thus allowing the second support frame 312 to be embedded in the first frame body 3111. At a side facing away from the second support frame 312, the first support rod 3112 is located at the inner side of the first frame body 3111, so as to form the soft flock collecting area Q1, thus allowing the first support frame 311 to have a box-shaped structure at the windward side, in which the box-shaped structure of the first support frame 311 has a strong soft flock collecting function.

In some embodiments, as shown in FIG. 2, the second support frame 312 includes a second frame body 3121 having an annular shape and a second support rod 3122 disposed in the second frame body 3121. In this way, the second support frame 312 has a simple structure and is easy to be produced, and moreover the structure strength of the second support frame 312 can be improved by providing the second support rod 3122.

Specifically, as shown in FIGS. 1 and 2, the second support rod 3122 is parallel to and staggered with the first support rod 3112, so as to further improve a supporting effect on the soft-flock filtering mesh.

Optionally, in a thickness direction of the second support frame 312, a dimension of the second frame body 3121 is equal to that of the second support rod 3122, so that the structure strength of the second support frame 312 can be improved, and also, deformation and fracture of the second support frame 312 can be avoided.

In some embodiments, the heat pump module includes a condenser 2, an evaporator 3, a fan, a compressor 4 and a throttling device (not shown), etc. The compressor 4, the throttling device, the condenser 2 and the evaporator 3 define a refrigeration cycle path of a refrigerant, and the fan is used to drive an airflow passing by laundry to flow through the evaporator 3 and the condenser 2 in turn, and further to flow to the laundry again, so as to form the circulating air.

When the heat pump module works, the compressor 4 compresses the refrigerant therein into a high temperature and high pressure gas refrigerant, then the high temperature and high pressure gas refrigerant is pumped into the condenser 2 to release heat and to be condensed into a low temperature and high pressure refrigerant, then after flowing through a dryer and being throttled by the throttling device, the refrigerant turns into a low temperature and low pressure gas-liquid two-phase refrigerant, then the low temperature and low pressure refrigerant flows into the evaporator 3, absorbs heat therein and evaporates into a low temperature and low pressure gas refrigerant, and eventually the refrigerant in the evaporator 3 returns to the compressor 4 to be compressed again, in such way a cycle is repeated.

Due to a condensation and an evaporation of the refrigerant in the condenser 2 and the evaporator 3, the air flowing therethrough can be heated and cooled. Under the driving of the fan, the air can flow circularly between the heat pump module and a drum where the laundry is to form the circulating air, so as to dry the laundry in the drum gradually.

Specifically, when the fan is started, the laundry in the drum is flipped ceaselessly, the heat pump module provides the drum with a dry and hot airflow, and then under the heating of the dry and hot airflow, moisture of the laundry absorbs heat and evaporates into water vapor. The airflow mingled with the water vapor flows from the drum into the heat pump module. The wet air in the heat pump module firstly flows through the evaporator 3. Since the refrigerant in the refrigeration cycle path absorbs heat in the evaporator 3, a temperature of the air flowing through the evaporator 3 in an air circulating path is reduced sharply. After the air is cooled, the water vapor in the air condenses into fluid drops or water mist, and the fluid drops or water mist adhering to the surface of the evaporator 3 can flow downwards along the evaporator 3 under a gravity effect.

The humidity of the air after being cooled is reduced, and then the air flows through the condenser 2. Since the refrigerant in the refrigeration cycle path releases heat in the condenser 2, the air flowing through the condenser 2 in the air circulating path is heated, so that the airflow turns into the dry and hot air, and then the dry and hot air is blown back to the drum again. The dry and hot air dries the laundry in the drum after entering the drum. The dry and hot air absorbs the moisture of the laundry, then turns into a wet and hot air, and the wet and hot air is blown out again. In such way, the cycle is repeated. The refrigeration cycle of the refrigerant cooperates with the air circulation in the device so as to dry the laundry in the drum quickly.

Specifically, the heat pump module includes a heat pump mounting box 1, and the heat pump mounting box 1 includes a base 100 and an air channel guiding plate 200.

Specifically, the base 100 is provided with an air suction port (not shown) and a mounting cavity 110. The air channel guiding plate 200 is mounted to the base 100 and defines an air guiding channel 210 with the base 100. The air guiding channel 210 has an inlet 211 and an outlet 212, the inlet 211 is communicated with the air suction port, and the outlet 212 is communicated with the mounting cavity 110. An outer top wall surface of the air channel guiding plate 200 schematically indicates the air guiding channel 210 in FIGS. 3 and 4.

Specifically, the soft-flock filtering mesh assembly 300 is drawably mounted to at least one of the base 100 and the air channel guiding plate 200, thereby removing the soft flocks.

It can be understood that, the mounting cavity 110 may be used for the evaporator 3 and the condenser 2 constituting the heat pump module, i.e., the evaporator 3 and the condenser 2 are mounted in the mounting cavity 110 respectively.

It should be noted that, the air channel guiding plate 200 may be fixed on the base 100 by a fastener such as a screw, or be connected with the base 100 by a snap, or be hot melted on the base 100. The soft-flock filtering mesh assembly 300 is drawably mounted to at least one of the base 100 and the air channel guiding plate 200, which includes following three situations: the soft-flock filtering mesh assembly 300 is drawably mounted to the base 100; the soft-flock filtering mesh assembly 300 is drawably mounted to the air channel guiding plate 200; and the soft-flock filtering mesh assembly 300 is drawably mounted to the base 100 and the air channel guiding plate 200.

Figure 4:
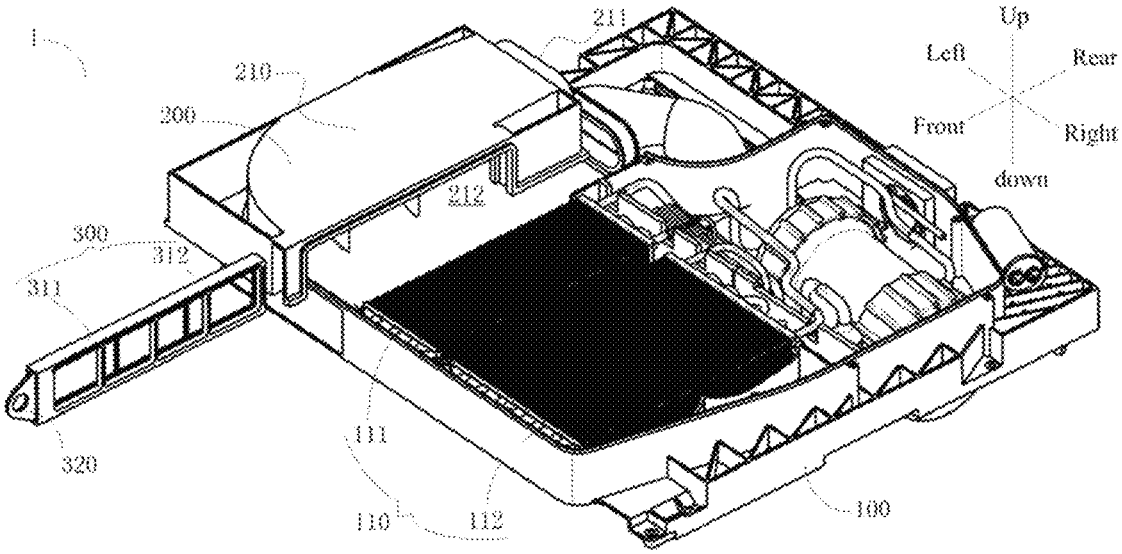
FIG. 4 is an exploded view showing a soft-flock filtering mesh assembly detached from a heat pump mounting box according to embodiments of the present disclosure.

Specifically, as shown in FIG. 4, the soft-flock filtering mesh assembly 300 is disposed at the outlet 212, so as to intercept the soft flocks in the dried air blown to the mounting cavity 110.

Thus, on one hand, since the air guiding channel 210 is communicated with the inlet 211 and the outlet 212 directly, the air flowing out from the drum can entirely enter the air guiding channel 210 through the air suction port, then entirely enter the mounting cavity 110 through the outlet 212 after being intercepted and filtered by the soft-flock filtering mesh assembly 300, and eventually exchange heat with the evaporator 3 and the condenser 2 in the mounting cavity 110, thereby avoiding loss of the dried air and preventing the condensed water from being gathered in the air guiding channel 210. On the other hand, since the soft-flock filtering mesh assembly 300 can be separately drawn out from at least one of the base 100 and the air channel guiding plate 200, the soft-flock filtering mesh assembly 300 can be drawn out to be cleaned easily, thereby avoiding accumulation or even leakage of the soft flocks.

From the above, the air channel guiding plate 200 is mounted on the base 100 and defines the air guiding channel 210 with the base 100, and the air guiding channel 210 is communicated with the inlet 211 and the outlet 212 directly. On the other hand, the soft-flock filtering mesh assembly 300 is drawably mounted to at least one of the base 100 and the air channel guiding plate 200, such that the heat pump mounting box 1 has a good connection leakproofness and is easy to be cleaned, and thereby it is not easy for the air quantity loss and the soft flock accumulation to come about.

Specifically, the mounting cavity 110 includes an evaporator mounting area 111 and a condenser mounting area 112, the evaporator 3 of the heat pump module is disposed in the evaporator mounting area 111, and the condenser 2 of the heat pump module is disposed in the condenser mounting area 112.

Figure 3:
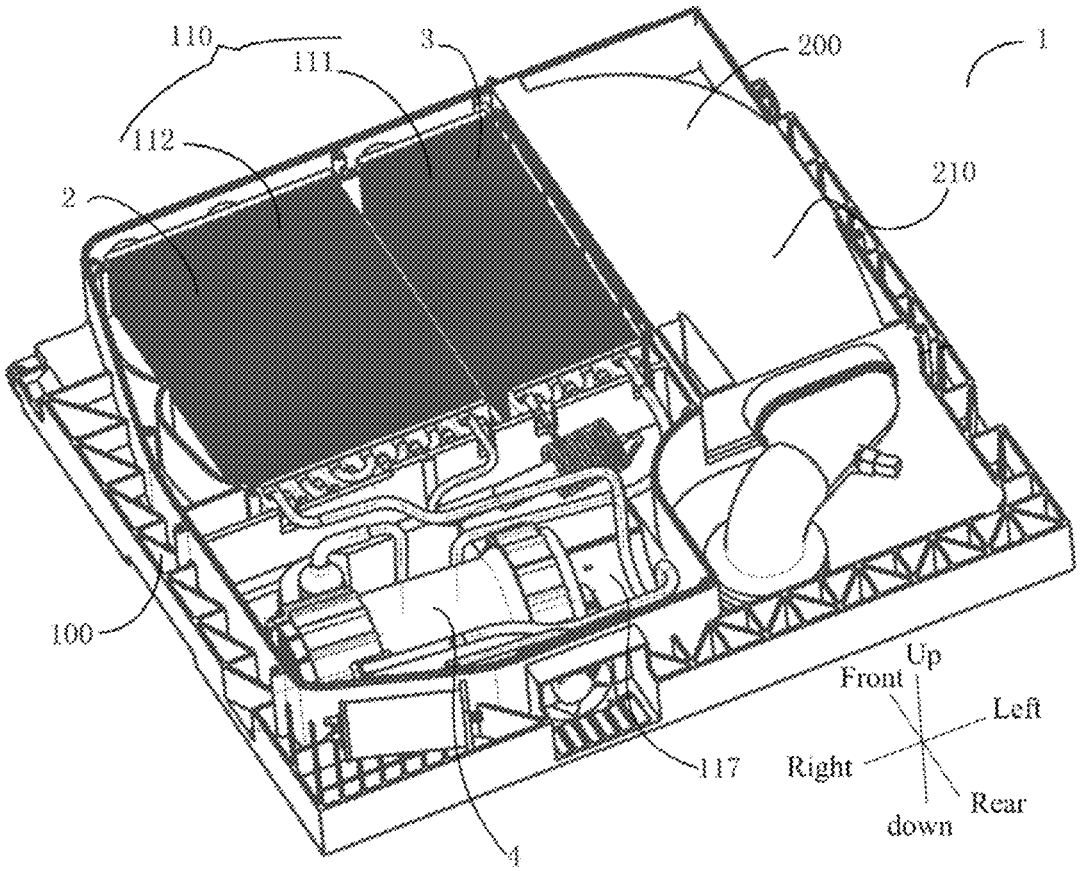
FIG. 3 is a perspective view showing a soft-flock filtering mesh assembly mounted in a heat pump mounting box according to embodiments of the present disclosure.

Further, as shown in FIGS. 3 and 4, the heat pump mounting box 1 is further provided with a compressor mounting area 117, the compressor 4 of the heat pump module is disposed in the compressor mounting area 117, and other parts (such as the fan, the dryer, and the throttling device) of the heat pump module are also mounted in the heat pump mounting box 1, such that the heat pump module can be assembled into a modular structure. Thus, when assembling the heat pump drying or washing-drying machine in a later period, it is very easy to assemble, detach and maintain the heat pump module.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A heat pump drying or washing-drying machine, comprising:

a heat pump module, wherein the heat pump module comprises a soft-flock filtering mesh assembly, the soft-flock filtering mesh assembly has a first support frame and a second support frame which are used for mounting a soft-flock filtering mesh, and the second support frame is embedded in the first support frame, so that the soft-flock filtering mesh assembly is capable of being mounted and dismounted as a whole, and the second support frame comprises a second frame body having an inner side and an outer side and fully enclosing an area for disposing at least a second support rod, wherein the first support frame includes a first frame body having an inner side and an outer side and fully enclosing an area that includes a soft flock collecting area, a support area, and a mounting area, wherein the first support frame includes at least a first support rod in the support area, wherein the first support rod has two side surfaces in a thickness direction of the first frame body that are not both flush with corresponding surfaces the first frame body in the thickness direction of the first frame body, wherein the first support rod is located on the inner side of the first frame body to form the mounting area to allow the second frame body to be embedded in the first frame body, and wherein the second support rod is parallel to and is offset from the first support rod by at least a portion of the soft flock collecting area of the first frame body.

2. The heat pump drying or washing-drying machine according to claim 1, wherein, the soft flock collecting area is located at a windward side of the soft-flock filtering mesh assembly.

3. The heat pump drying or washing-drying machine according to claim 1, wherein the first support frame is provided with a handle.

4. The heat pump drying or washing-drying machine according to claim 3, wherein the handle is configured to have a plate shape, and is provided with a draw hole.

5. The heat pump drying or washing-drying machine according to claim 1, wherein the heat pump module comprises a heat pump mounting box, and the heat pump mounting box comprises:

a base provided with an air suction port and a mounting cavity; and an air channel guiding plate mounted on the base and defining an air guiding channel with the base, the air guiding channel having an inlet communicated with the air suction port and an outlet communicated with the mounting cavity, wherein the soft-flock filtering mesh assembly is drawably mounted to at least one of the base and the air channel guiding plate.

6. The heat pump drying or washing-drying machine according to claim 5, wherein the soft-flock filtering mesh assembly is disposed at the outlet.

* * * * *